United States Patent [19]

Stobb et al.

[11] 4,060,231

[45] Nov. 29, 1977

[54] APPARATUS AND METHOD FOR STACKING SHEETS

[76] Inventors: Anton Rudolph Stobb, R.D. 1; Walter John Stobb, R.D. 1, Box 60, both of Pittstown, N.J. 08867

[21] Appl. No.: 728,547

[22] Filed: Oct. 1, 1976

[51] Int. Cl.[2] ..... B65H 29/40; B65H 31/32

[52] U.S. Cl. ..... 271/80; 271/187; 271/218; 214/6.5

[58] Field of Search ..... 271/65, 66, 70, 72, 271/80, 82, 185–187, 218; 214/6.5

[56] References Cited

U.S. PATENT DOCUMENTS

| | | | |
|---|---|---|---|
| 1,637,170 | 7/1927 | Zuckerman | 271/80 X |
| 1,646,710 | 10/1927 | Shmyroff et al. | 214/6.5 |
| 2,134,532 | 10/1938 | Quick et al. | 271/80 |
| 2,668,483 | 2/1954 | Sykes | 271/65 X |
| 3,298,683 | 1/1967 | Stroud | 271/218 |
| 3,568,578 | 3/1971 | Fujishiro | 214/6.5 |
| 3,749,239 | 7/1973 | Holdway et al. | 271/187 X |

*Primary Examiner*—Robert W. Saifer
*Attorney, Agent, or Firm*—Arthur J. Hansmann

[57] ABSTRACT

Apparatus and method for stacking sheets which are spaced apart on a conveyor. Two oppositely rotatable holders alternately receive the sheets from the conveyor and the holders have sheet engagers which move the sheets around to stack the sheets with the folds of sequential sheets in opposite directions in the stack to thus form a compensated stack relative to the folds. A receiver handles the stack, and it has a carrier for moving the stack away from the holders and it has an interceptor for initially receiving and forming the stack while the carrier is depositing the previous stack. Electrical apparatus, including sheet counters and drivers and control means for the holders, and switches and control means for the carrier and the interceptor, are all electrically interconnected for forming the stack in a certain counted number of sheets and for moving each stack. The method includes the steps mentioned above.

12 Claims, 3 Drawing Figures

APPARATUS AND METHOD FOR STACKING SHEETS

This invention relates to apparatus and method for stacking sheets, and, more particularly, it relates to apparatus and method for stacking sheets which have a folded edge and wherein the folds are laid in sequentially opposite directions in the stack to form a compensated stack which is level as the stack is formed.

BACKGROUND OF THE INVENTION

The prior art is already aware of many different arrangements for apparatus and method for handling sheets of paper or the like, and this prior art includes sheeters, stackers, collators, signature gatherers and feeders, and the like. In this prior art apparatus and method, sheets are handled by either taking them from an incoming stream and forming them into a stack or by taking a stack and distributing or separating the sheets from the stack, all for the general and well known purposes of handling sheets in the printing and magazine and bookbinding industry. Where sheets are handled from an original stream relation and formed into a stack, these sheets may be in a shingled stream form from which they are stripped off and formed into the stack, and one such example is seen in U.S. Pat. No. 3,653,656. Also, a prior art example of mechanism for taking sheets from a stack and into an individual position is shown in U.S. Pat. No. 2,903,260.

In prior art examples of handling sheets individually on rotating drums or the like, for the purpose of transferring the sheets and to either move them into a stream or stack position or move them from a stream or stack position, the aforesaid two U.S. patents show drums with grippers for individually moving the sheets in the rotation of the drum, and also U.S. Pat. Nos. 1,624,985 and 2,413,358 and 3,841,622 are examples of transfer drums or the like with sheet gripper members thereon.

The present invention differs from the prior art in that it provides apparatus and method for handling folded sheets which are spaced apart on a conveyor or the like and which are moved to two oppositely rotated spider or like members which have engagers for alternately receiving the sheets and moving them into a stack so that the fold can be on opposite sides of the stack for adjacent ones of the sheets in the stack. As such, the present invention provides a compensating type of stacker which takes into account the location and effect of a folded sheet or signature in a stack. Thus the present invention provides apparatus and method for stacking folded signatures in alternate directions to form a level or truly vertical stack which is not tipped because of the folds which might otherwise be located completely on one side of the stack to create the tipped stack.

Further, the present invention provides apparatus and method which rapidly and accurately handles the folded sheets or signatures moved on a conveyor to the stack location, and it completely automates the process and the operator need not handle the sheets from the time that they are in a spaced-apart relation on an incoming conveyor and to the time that they are placed in a straight stack and moved away from the location of forming the stack. Additionally, the present invention provides the apparatus and method for accurately counting the number of sheets or signatures in each stack, and the invention automatically accomplishes the accurate counting and moves the counted stacks to one side when the stack is accurately completed, as mentioned. Still further, the present invention provides apparatus and method which accomplishes the aforementioned objectives and which does so without pinching, piercing, or otherwise detrimentally engaging or gripping the folded sheets or signatures when they are placed into the stack. That is, the sheets are not physically distorted or damaged, and the invention handles the sheets without any damage thereto and in fact the apparatus improves the fold characteristic of the sheets in the process of forming them into a stack.

Still further, the present invention provides apparatus and method for handling finished magazines, that is a number of sheets in a folded relationship, and the magazines are inherently thick and therefore the present invention provides the manner for handling the magazines which are flowing directly from a binder, and the magazines need not be physically gripped, pierced, or otherwise held or engaged by the apparatus of this invention which receives and deposits the magazines into the compensated stack mentioned but does so without compressing, piercing, or otherwise damaging or marking the magazines.

As further background, the prior art present day manner of stacking magazines or books or the like is to collect a number of the magazines or the books or the like with the folds on only one side of the stack, and then another number of the magazines or the books is collected with the folds placed on the other side of the stack, so that eventually the stack can be level but the two groups of sheets must be separately collected and separately positioned opposite each other for ultimately forming a somewhat level or straight stack of sheets. The present invention avoids the aforementioned concerns and involvement and the resulting inferior stack, and the present invention forms a truly compensated stack with the folds of the magazines or books being alternately disposed on opposite sides of the stack to form a straight and balanced stack. The prior art is already aware of arrangements for counting sheets which are formed into a stack, and one such example is found in U.S. Pat. No. 3,969,993, and the present invention includes arrangements for counting the folded books or magazines and to form the counted compensated stack in an accurate number of folded products and to then move that counted stack away from the location of its formation.

Other objects and advantages will become apparent upon reading the following description in light of the accompanying drawings.

DETAILED DESCRIPTION OF THE PREFERRED EMBODIMENT AND METHOD

Figure 1:
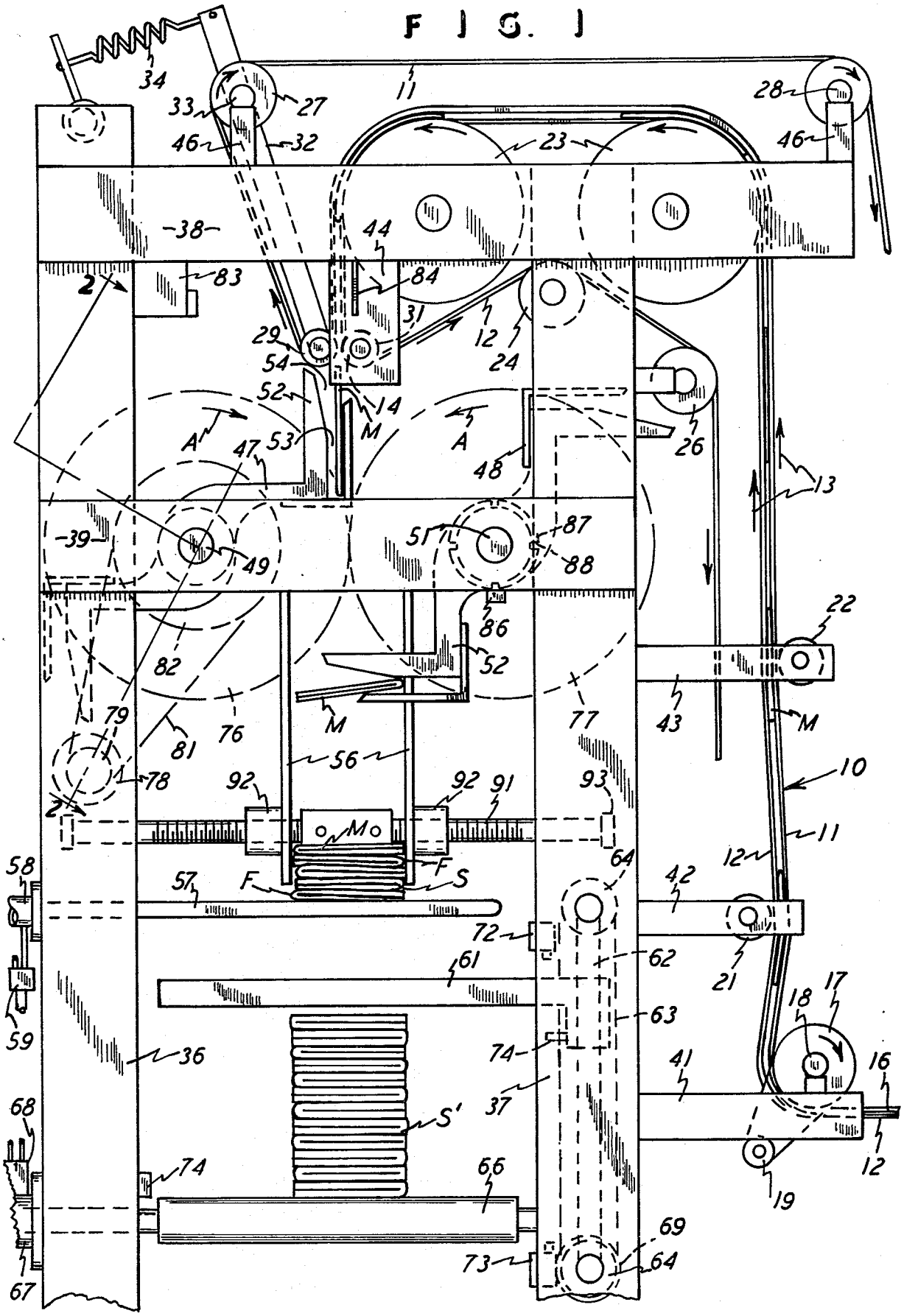
FIG. 1 is a side elevational view of one embodiment of this invention.

The center of FIG. 1 shows a portion of the stack S of folded sheets which may be signatures or books or magazines, and it will be seen that the sheets have their folded edges designated F on opposite sides of the stack S, and thus the apparatus and method of this invention produces the so-called compensated stack where the folds are on opposite sides of the stack S in adjacent ones of the signatures or books or magazines designated M. Further, it will be seen and understood that the description of the apparatus also discloses the method and its various steps for transporting and collecting the product M in the compensated stack S.

An incoming conveyor 10 consists of two conveyor belts 11 and 12 which carry the product M between the belts and from other but unshown apparatus, such as a binder or the like. The product M is transported by the conveyor 10 in the direction of the arrows designated 13, and thus the sheets or products M are moved to the conveyor 10 terminal end designated 14, and the sheets are moved along a path which extends vertically, as shown in FIG. 1, from the conveyor terminal end 14 and down to the center of the stack S, that is, the vertical path is along the vertical plane of the product M shown descending from the conveyor terminal end 14.

The conveyor 10, and its individual belts 11 and 12, are adequately guided by and trained about the various rollers and pulleys shown along the path of the conveyor 10, and thus the conveyor 10 may have an initial horizontal section designated 16 which is actually receiving the magazines M which are dropped onto the conveyor belt 12 and are moved to the positions shown in FIG. 1. A driving type pulley 17 is shown to be rotatably mounted on a shaft 18 and is rotated by means of a motor designated 19. Thus the conveyor 10 is suitably powered to move in the directions of the arrows 13 and to carry the magazines M between the belts 11 and 12 and to the conveyor terminal end 14, as mentioned. Tensioning rollers 21 and 22 are also suitably mounted and guide the belts 11 and 12, as do rollers 23 which lead the belts 11 and 12 to the terminal end 14. The belt 12 is shown further trained about pulleys 24 and 26, to have the belt 12 return to the location of the binder, and the belt 11 is shown trained about pulleys 27 and 28 to have the belt 11 also return to the beginning location of the horizontal section 16. All in a manner which will be readily understood by one skilled in the art. Further, the conveyor terminal end 14 has pulleys 29 and 31 on which the belts 11 and 12 are respectively trained to present the conveyor terminal end 14. The pulley 31 is shown to be in a fixed position, and the pulley 29 is shown to be supported on a pivot arm 32 which pivots about a shaft 33 under the influence of a tension spring 34, and thus the pulley 29 is pressed toward the pulley 31 and thus further compresses the product M as it passes through the terminal end 14, and this assures that the product M is directed in the desired path mentioned and into the apparatus hereinafter described so that the compensating stack can be properly formed. At this time it will then also be noticed that necessary apparatus framework is provided, such as the upright posters or standards 36 and 37 and the crossbars 38 and 39 which are suitably attached to the standards 36 and 37 to form a rigid frame and to support the members described and to be hereinafter described. Further, the frame includes extending arms 41 and 42 and 43 and the arms 44 and 46, at the upper end of the framework, all for supporting the pulleys described so that the pulleys can rotate in the directions of arrows shown thereon or in consistant directions with the arrows shown on the belts 11 and 12. Again, anyone skilled in the art will understand the arrangement of the necessary framework for supporting the rotatably mounted pulleys and the movable belts and the movable apparatus hereinafter described.

Accordingly, it will be seen that the conveyor 10 moves the product M in spaced-apart relation and in a stream with the folded edges F being in a leading position on the conveyor 10, and the product M is moved to a path extending through the conveyor terminal end 14 and away from the conveyor 10, and that path is actually a vertical path shown by the product M at the location immediately below the terminal end 14. Accordingly, the product M is engaged by two counter-rotating members or spiders 47 and 48, and these members are rotatably mounted on shafts 49 and 51, respectively, and the shafts are in turn supported on the crossbar 39 of the framework described. The members 47 and 48 rotate in opposite directions, as shown by the arrows designated A thereon, and the members 47 and 48 are shown to each include two engagers designated 52 and being diametrically oppositely located on each of the two rotating members 47 and 48. The engagers 52 present pockets 53 which are made available to the product M, as shown in FIG. 1 with the engager 52 immediately below the conveyor terminal end 14 and receiving the product M therein. As such, the engagers 52 need not physically grip the product M, and thus the product M can be securely controlled by the engagers 52 but not be damaged thereby, and also the pocket 53 is sufficiently large to hold the folded magazine or book or the like in the form of the product M. Accordingly, the pocket 53 has an open or mouth end 54 which aligns with the conveyor terminal end 14 for receiving the product M, as mentioned and as shown, and it will be seen that the mouth or entryway 54 for the pocket 53 is widened at its outer end for suitably receiving the product M.

Figure 2:
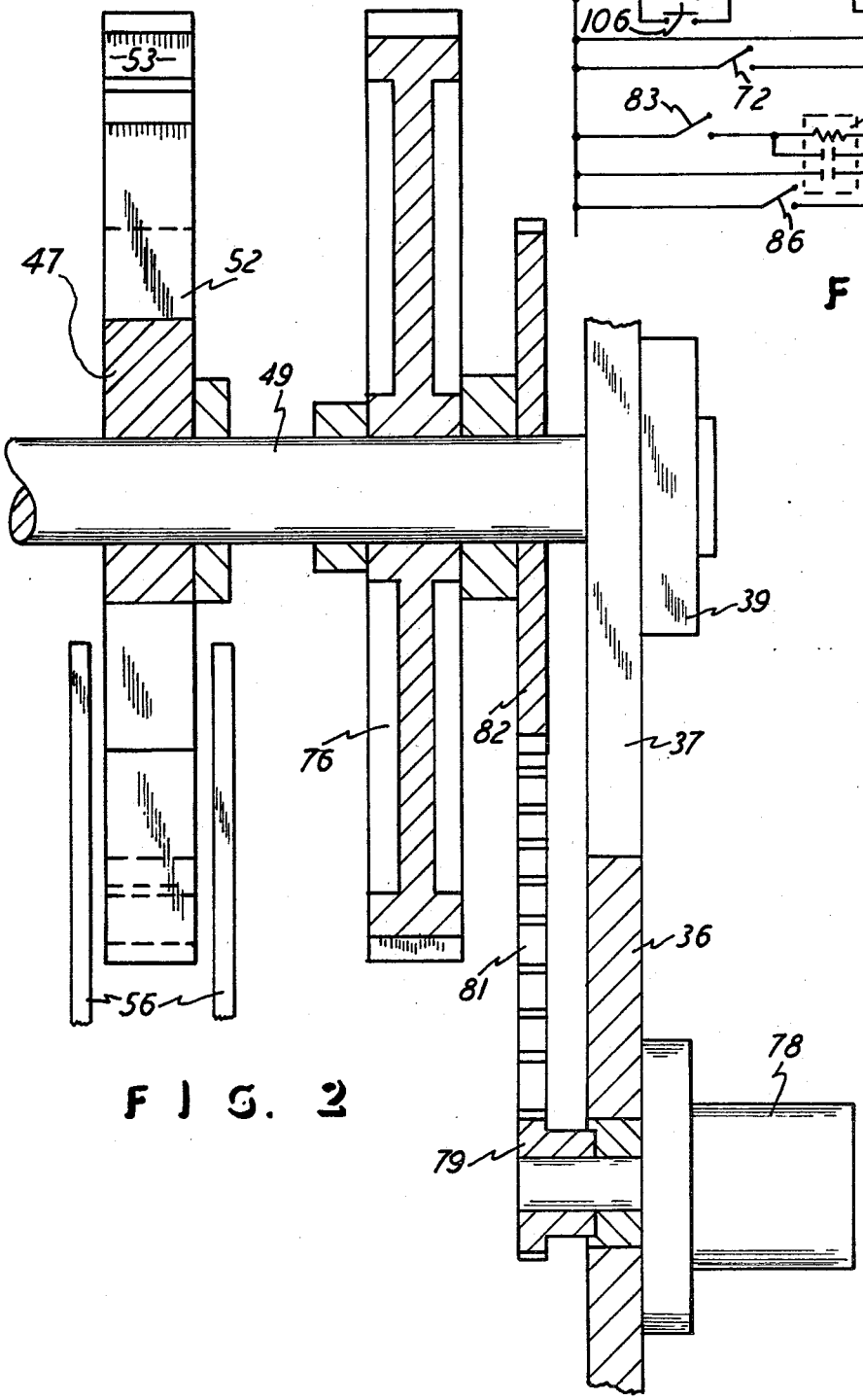
FIG. 2 is a sectional view taken along line 2—2 of FIG. 1, and with the holder shown rotated.

Stripper members 56 are disposed below the rotating spiders 47 and 48 but extend to the circular scribed path of the spider engagers 52 and the engagers 52 and the strippers 56 are alternately located to be interlinked as passing fingers relative to each other, and thus the product M is stripped from the engagers 52 when the engagers 52 are rotated down to the location of the stripper fingers 56, as indicated in connection with the engager 52 on the spider member 48 as shown in FIG. 1. Of course from that position of being stripped from the engagers 52, the product M falls into the stack S until an adequate number of the products are accumulated in the stack S, as hereinafter described. FIG. 2 shows the arrangement for the alternate action of the spider members 47 and 48 and the stripper members 56, and it will therefore be seen and understood that the two items are interrelated to overlap but of course not to interfere with each other so that the engagers 52 can rotate on a circular path past the strippers 56 which extend into that circular path and engage the product M to remove it from the engagers 52, all as shown in FIGS. 1 and 2 and as indicated with the stripper 48 in FIG. 1 and the product M being released from the engager 52 by encountering the stripper 56.

The strippers 56 thus form a receiver for the sheets, and an interceptor member 57 is disposed below the stack S to have the stack stand thereon, and the interceptor 57 is movably disposed on the frame piece 36, such as by being under the influence of a fluid cylinder assembly 58 which may be mounted on the member 39 and which is connected with an air valve 59 for actuating the cylinder assembly 58 to thereby horizontally project and retract the support 57 which may be in the form of a plate or the like or supporting the stack S as it is initially formed, and as shown in FIG. 1. The receiver also includes a vertically movable carrier 61 which has a suitable platform and which is movable up and down by powered apparatus to thus position itself in line with the stack S and to receive the stack when the rod or plate 57 is rapidly withdrawn from the position shown and to the left and into the cylinder assembly 58 to thereby have the stack S fall down onto the raised carrier 61. The carrier 61 can then continue to receive the incoming product M forming between the strippers 56, and the carrier 61 can be gradually lowered by having it move along a vertical post 62 on which the carrier 61 is vertically slidable under the influence of a sprocket chain 63 and two rotatably mounted sprockets 64 suitably mounted on the frame piece 37. Thus, the carrier 61 and the post 62 are in a pillow block conventional arrangement, and the carrier 61 is connected to the chain 63 which moves around the sprocket 64 to have the carrier 61 move up and down for lowering the stack S down to rotatably mounted rollers 66 which are shown suitably mounted on the frame pieces 36 and 37, and thus the finished stack S' is shown in the roller 66. Here again, the carrier 61 and the rollers 66 have interposed fingers or sections which pass each other so that the carrier 61 can move below the interposed roller 66 and thus deposit the stack from the carrier 61 and onto the rollers 66, in a well understood and an arrangement appreciated by one skilled in the art. That is, the carrier 61 may have several projecting spaced-apart fingers, and the rollers 66 may be several in number, and both are horizontally disposed and the fingers of the carrier 61 can move into the spaces between the rollers 66 when the carrier 61 is lowered to transfer the stack S' to the rollers 66. The rollers 66 are rotatably powered, such as by the electric motor 67 suitably arranged and mounted on the frame member 36 and having the electric switch 68 connected therewith so that the rollers 66 can be rotated in one direction about their horizontal axes and thus transfer the stack S' to a location away from the location directly under the stripper fingers 56. Likewise, the carrier 61 is under the influence of the lowering mechanism, such as the sprocket chain 63 and sprocket 64 which are connected with an electric motor 69 which is in suitable driving relation with the lower sprocket 64.

At this time it will also be mentioned that electric microswitches 72 and 73 are disposed on the frame member 37 above and below the path and extensive movement of the carrier 61, and the carrier 61 abuts the switches 72 and 73, such as by means of the top of the carrier 61 moving upwardly against the switch 72 and by the means of a projection 74 affixed to the carrier 61 and moving downwardly onto the switch 73 when the carrier 61 has moved to below the upper surface of the rollers 66. As such, the switches 72 and 73 control the motor 69 and determine the forward or reverse direction of rotation of the motor 69 for the raising and lowering of the carrier 61, as will be understood and as will be further explained in connection with FIG. 3. Also, a photo-sensitive eye unit 74 is mounted on the frame member 36 and scans across of the rollers 66 to observe the presence or absence of a stack S', and the photo-eye unit 71 is suitably electrically connected with the switch 68 and lower microswitch 73 to thereby synchronize the rotation of the rollers 66 with the lowering of the carrier 61 and the deposit of the stack S' onto the rollers 66, as further seen in FIG. 3.

The spider or rotating members 47 and 48 are interrelated to rotate in unison and in the opposite directions mentioned, and they are therefore arranged with a gear 76 and 77, respectively, on each of the units 47 and 48, and the gears are shown to be in rolling contact and thus the units 47 and 48 rotate together. A driving motor 78 is suitably arranged and has a sprocket 79 and a drive belt or the like 81 extending to a driven pulley or the like 82 on the shaft 49. Thus, the spider 47 is initially driven by the electric motor 78, and the spider 48 is consequently also rotated, and FIG. 2 shows more of the drive arrangement and structure just described. A photo-sensitive eye unit 83 is mounted on the frame member 36 and is directed to scan across the vertical path of the product M and be directed to a deflector plate 84. Thus, the unit 83 is responsive to the passing of the product M in the sight or path of the eye unit 83, and the unit 83 is connected with a switch for controlling the operation of the motor 78 which actually indexes or moves in increments for purposes of positioning the pockets 53 on the units 47 and 48 in line with the terminal end 14 of the conveyor 10. That is, the unit 83 has a control switch which induces rotation of the motor 78 and thus the units 47 and 48, and another photo-eye type of switch 86 is disposed in connection with the unit 48 to stop the rotation of the motor 78 since the eye 86 is connected with the motor 78, all as hereinafter described in connection with FIG. 3. A notched plate 87 rotates with the unit 48 and has four notches or portions 88 which are presented to the photo-eye unit 86 to thereby activate the unit 86 and thus cause the spiders 47 and 48 to move one-quarter of a turn before the photo-eye 86 causes the motor 78 to stop rotation of the units 47 and 48, and that is when one of the engager pockets 53 is again aligned with the conveyor terminal end 14 for receiving one of the magazines M. Accordingly, the sensor of the photo-eye and switch unit 83 commences the energizing of the motor 78, and the sensor of the photo-eye and switch unit 86 interrupts the energizing of the motor 78, and thus the spiders 47 and 48 are moved in one-quarter revolution increments so that the respective pockets 53 are stopped below the terminal end 14 for receiving the product M on alternate ones of the units 47 and 48.

Since the units 47 and 48 move to have the engagers 52 scribe circles on opposite sides of the extended path of the conveyor terminal end 14, that is the vertical path below the terminal end 14, and since the engagers 52 move substantially tangentially to that vertical path and since they alternately receive the product M which is fed relative to the folded edge which may be in either the leading or trailing direction, the result is that the stack S is formed with the folds oppositely disposed, as mentioned.

It will also be seen that the stripper fingers 56 are adjustably mounted on a threaded shaft 91 suitably mounted in the frame pieces 36 and 37 to extend thereacross and to have the threaded section thereon which engages bosses 92 affixed to the fingers 56. The bosses 92 are opposite the threaded members in the interior thereof, and thus rotation of the shaft 91 will cause the members 92 to move toward or away from each other, simultaneously, and thus the fingers 56 are simultaneously moved toward or away from each other to thereby provide an adjusted space therebetween to accommodate various lengths of product M. It will of course be understood that the shaft 91 is off to one side and not centrally located and it therefore does not interfere with the central formation of the stack S on the apparatus shown and described. To this end, interconnector frame members 93 extend between the two standards 37, one of which is shown and the other of which would be directly behind the shown one, and the same arrangement is made for the standard 36 so that there are four standards 36 and 37, in total, and the interconnecting members 93 extend therebetween to support the draft 91 to one side of the central portion of the framework and thus permit the clearance for the stack S, as necessary and as will be understood by one skilled in the art.

Figure 3:
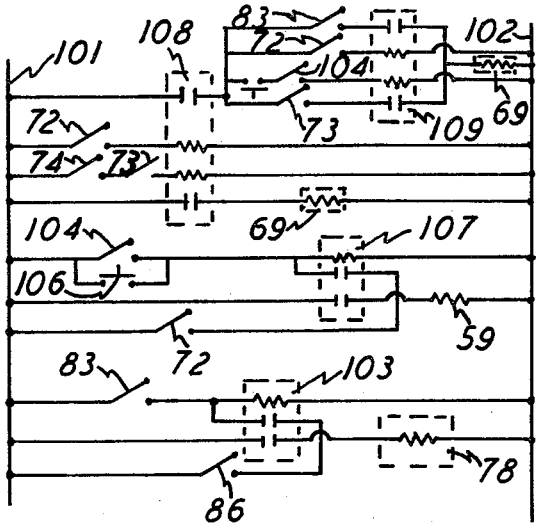
FIG. 3 is an electric schematic view of the electric apparatus utilized in the system shown.

FIG. 3 shows an electric schematic and further describes the apparatus and method of this invention, and it will here be understood that there are electric power lines 101 and 102, and the several switches and photo-eye units are also shown in the schematic and they are connected with the lines 101 and 102 and with the several electric motor units shown and described in FIG. 1 and FIG. 2. Thus, the schematic drawing shows the electric motor 78 connected with the photo-eye sensitive switch units 83 and 86 which are normally closed switch units and which connect with a conventional latching type relay 103. When the equipment is operating, the switch 83 is thus in its closed position and it therefore sets the latching relay 103 closed to energize the motor 78 and thus rotate the spider units 47 and 48, as mentioned. The motor 78 is thus started and under control of the photocell 83 which is opened when the product M moves in front of the deflector plate 84, and the photocell and its switch 86 stop the motor 78 by opening the switch when the slot or notch 88 aligns with the photocell eye unit 86, all as shown in the lower portion of the schematic wiring diagram of FIG. 3. Next considering the action of the interceptor member 57, this may be arranged to be similar to the counting unit and interceptor member of U.S. Pat. No. 3,969,993 such that the member 57 is inserted into the receiver and under the product M to form the stack S when a certain number of folded sheets M have gone through the apparatus and a new stack is then to be formed. Accordingly, the apparatus may include a counter member and switch designated 104 which may have a manual switch shown at 106, and of course the switches are connected across the lines 101 and 102 and there is a latching relay 107 and the drawing shows the intercept solenoid valve 59. The microswitch 72 is a normally closed switch, and is shown connected with the relay 107 and the solenoid 59, and the counterswitch 104 is a normally open switch such that when the counter 104 is satisfied in the numbers of products M moving therepast and through the apparatus, the counterswitch 104 will close and activate the relay 107 which thereby energizes the solenoid valve 59 to position the interceptor member 57 below the stack and thus leave the counted stack move down with the carrier 61 and away on the rollers 66. Once the carrier 61 moves back up to trip the switch 72 and thus open it, the counter is then also open and thus the relay is de-energized and the solenoid valve is not energized and therefore the interceptor member 57 will retract and the sheets on the member 57 will be dropped onto the carrier 61 which will again lower the stack and continue to support it as additional sheets are placed thereon until the suitable count is again reached and the process is repeated. Finally, the upper portion of the schematic diagram of FIG. 3 shows the elevator motor 69 connected with the latching relays 108 and 109 and with the switches 72 and 73 and 74 and 83. Thus, when the carrier 61 is lowered it contacts the switch 73 which is a normally open switch, and the switch 73 is thus closed, and the switch 74 is normally closed and therefore the lower portion of the latching relay 108 is energized to energize the carrier motor 69 to run in a reverse direction to cause the carrier 61 to move upwardly. Again, when the carrier 61 contacts the switch 72, the switch 72 has a normally open side as shown in the portion of the schematic connected with the relay 108 and that action closes that portion of switch 72 to energize the latching relay 108 and thus arrange for operation of the latching relay 109. The normally open side of the microswitch 72 is shown also adjacent the latching relay 109, and the counter 104 is also shown in that location, and the arrangement is such that switch 73 also has a normally closed side and when the counter 104 is satisfied it will close, and the normally closed side of switch 73 will complete the necessary circuit for the motor 69 which is driven in the forward direction for lowering the carrier 61. The upper portion of the schematic also shows the photo-eye unit switch 83 has a normally open side connected with the relay 109, and when the product M passes the photo-eye 83 that side will close to again control the circuit for energizing the motor 69 in the forward direction and through the latching relay 109. Accordingly, from the showing of the schematic diagram in FIG. 3, and from the showing of the arrangement in FIG. 1, one skilled in the art will readily understand the arrangement of the elements for the electric controls and switching for the various functions described.

Also, from the aforementioned description of the apparatus and the various functions thereof, one will understand the method steps of this invention. Fundamentally, the method is to move the folded books or magazines or product M in a stream and spaced apart relationship, as shown on the conveyor 10, and to a position where it has a vertical path exit as it enters the spider members 47 and 48. The folded edge F may be the leading or trailing edge, and the product M is engaged at its leading edge and they are moved alternately to opposite sides of the vertical path to direct the folded edges of the sheets alternately to one side and the other side of the path, and the sheets are interrupted in the movement of the two opposite sides to form the stack S with the folded edges of consecutive ones of the sheets disposed on alternate opposite sides of the stack. Also, the sheets are sensed in their movement, and they are counted as they are moved into the stack, and of course the sheets are monitored at a certain rate of moving on the conveyor 10 and the aforementioned steps of moving and stripping and intercepting and stacking are synchronized with the monitoring movement, all as explained in the aforementioned. Finally, the sheets formed in the stack S' are moved away from the location of formation, such as by the rollers 66 and under the action of the electronic or photo-eye 74. As such, the method steps are completely disclosed herein and will be understood by anyone skilled in the art.

What is claimed is:

1. Apparatus for stacking sheets of paper, comprising a conveyor for supporting sheets of paper in end-to-end spaced-apart relation and with said conveyor having a terminal end where the sheets are released from said conveyor along a path extending from said conveyor, two rotatably mounted sheet holders disposed adjacent said terminal end and each having a sheet engager for individually releasably receiving the sheets from said conveyor and moving the sheets away from said conveyor and being arranged to drop the sheets into a stack when said holders are rotated, said holders being disposed on opposite sides of said path of the sheets released by said conveyor and being rotatably driven in opposite directions, a rotation driver operatively associated with said holders and a sheet movement detector arranged to monitor the sheets moving toward said holders and with said driver and said detector being operatively associated together for the control of rotation of said holders in synchronization with the movement of the sheets, an additional control for rotation of said holders and arranged to interrupt holder rotation every one-quarter revolution thereof, and said additional control and said detector being operatively associated together for respectively stopping and starting of rotation of said holders for receiving and releasing of the sheets, and a receiver operatively disposed relative to said holders for receiving the sheets from said holders and in a stack when the sheets are released by said engagers.

2. The apparatus for stacking sheets of paper as claimed in claim 1, wherein the sheets are folded along one of the leading and trailing edges thereof, said engagers being disposed on said holders to scribe a circular path tangential to said path of the sheets on said conveyor and for receiving the sheets relative to the folds, and strippers disposed in said circular path of said sheets for alternately contacting said sheets on said holder and thereby consecutively stack the sheets with their folds on alternate opposite sides of the stack.

3. The apparatus for stacking sheets of paper as claimed in claim 1, wherein said receiver includes a stripper member disposed beneath each of said holders for guiding the dropping of the sheets from said holders, and said receiver includes a vertically movable carrier movably mounted for movement up and down beneath said holders to carry the stack of sheets away from said holders.

4. The apparatus for stacking sheets of paper as claimed in claim 3, including an interceptor movably disposed adjacent said receiver and being movable to a position immediately beneath said stripper members and into the path of the sheets dropping from said holders for temporarily supporting the sheets at a time when said carrier is moving up and down.

5. The apparatus for stacking sheets of paper as claimed in claim 1, wherein said engagers have pockets on said holders and have openings faced in the path of the sheets coming from said conveyor when said holders are rotated to positions where said pockets are adjacent said conveyor.

6. The apparatus for stacking sheets of paper as claimed in claim 1, wherein said detector is a photo sensitive eye unit and said driver is an electric motor, and said eye unit and said motor being electrically connected together.

7. Apparatus for stacking sheets of paper, comprising a conveyor for supporting sheets of paper in end-to-end spaced-apart relation and with said conveyor having a terminal end where the sheets are released from said conveyor along a path extending from said conveyor, two rotatably mounted sheet holders disposed adjacent said terminal end and each having a sheet engager for individually releasably receiving the sheets from said conveyor and moving the sheets away from said conveyor and being arranged to drop the sheets into a stack when said holders are rotated, said holders being disposed on opposite sides of said path of the sheets released by said conveyor and being rotatably driven in opposite directions, a rotation drive operatively associated with said holders and a sheet movement detector arranged to monitor the sheets moving toward said holders and with said driver and said detector being operatively associated together for the control of rotation of said holders in synchronization with the movement of the sheets, a receiver operatively disposed relative to said holders and including a stripper member for guiding the dropping of said sheets from said holders and including a vertically movable carrier for receiving the sheets from said holders and in a stack when the sheets are released by said engagers, an interceptor movably disposed adjacent said receiver and being movable to a position immediately beneath said stripper members and into the path of the sheets dropping from said holders for temporarily supporting the sheets at a time when said carrier is moving up and down, said driver and said detector being electrical members, and additional electrical members operatively connected with said carrier and with said interceptor, all said electrical members being electrically connected together for synchronized operation of said driver and said carrier and said interceptor in the sequential dropping of the sheets and the intercepting of the dropped sheets to form a stack and the carrying of the stack away from said holders.

8. The apparatus for stacking sheets of paper as claimed in claim 7, wherein the sheets are folded along one of the leading and trailing edges thereof, said engagers being disposed on said holders to scribe a circular path tangential to said path of the sheets exiting from said conveyor and for receiving the sheets relative to the folds, and said stripper members being disposed in said circular path of said sheets for alternately contacting said sheets on said holders and thereby consecutively stack the sheets with their folds on alternate opposite sides of the stack.

9. The apparatus for stacking sheets of paper as claimed in claim 8, including an additional control for rotation of said holders and arranged to interrupt holder rotation every one-quarter revolution thereof, and said control and said detector being operatively associated together for respectively stopping and starting of rotation of said holders for receiving and releasing of the sheets.

10. Apparatus for stacking sheets of paper, comprising a conveyor for supporting sheets of folded paper in end-to-end spaced-apart relation and with said conveyor having a terminal end where the sheets are released from said conveyor along a path extending from said conveyor and with said path being transverse to the length of the fold in said sheets, two rotatably mounted sheet holders disposed adjacent said terminal end and each having a sheet engager for individually releasably receiving the sheets from said conveyor and moving the sheets away from said conveyor and being arranged to drop the sheets into a stack when said holders are rotated, said holders being disposed on opposite sides of said path of the sheets released by said conveyor and being rotatably driven in opposite directions, each of said holders having at least two said engagers equi-distant spaced around said holders extending therefrom and across said path of said sheets and with said engagers presenting sheet-receiving pockets and with said holders being rotatably driven in synchronization to have said pockets in staggered relation to alternately cross said path of said sheets to alternate in receiving said sheets and thereby being arranged to release said sheets into a stack with the folds of adjacent sheets on alternate sides of the stack, a rotation drive operatively associated with said holders and a sheet movement detector arranged to monitor the sheets moving toward said holders and with said driver and said detector being operatively associated together for the control of rotation of said holders in synchronization with the movement of the sheets, an additional control for the rotation of said holders and arranged to interrupt holder rotation when said pockets cross said path of said sheets and thereby have said sheets fall into said pockets, and a receiver operatively disposed relative to said holders for receiving the sheets from said holders and in a stack when the sheets are released by said engagers.

11. Means for stacking sheets of paper, comprising means for supporting sheets of paper in end-to-end spaced-apart relation and with said means having a terminal end where the sheets are released from said means along a path extending from said means, two rotatably mounted means disposed adjacent said terminal end and each having sheet engager means for individually releasably receiving the sheets from the first said means and moving the sheets away from the first said means and being arranged to drop the sheets into a stack when the second said means are rotated, the second said means being disposed on opposite sides of said path of the sheets released by the first said means and being rotatably driven in opposite directions, rotation driver means operatively associated with the second said means and a sheet movement means arranged to monitor the sheets moving toward the second said means and with said driver means and said sheet movement means being operatively associated together for the control of rotation of the second said means in synchronization with the movement of the sheets, an additional control means for rotation of said rotatably mounted means and arranged to interrupt rotation every one-quarter revolution thereof, and said control means and said sheet movement means being operatively associated together for respectively stopping and starting of rotation of said rotatably mounted means for receiving and releasing of the sheets, and receiver means operatively disposed relative to the second said means for receiving the sheets from the second said means and in a stack when the sheets are released by said sheet engage means.

12. A method for stacking sheets of paper having a folded edge, including the steps of moving the sheets in a path with the sheets spaced apart and with one of the leading and trailing edges being the folded edge, presenting sheet engagers to the sheets in the path and stopping the sheet engagers until they receive one of the sheets, engaging the sheets at their leading edges and moving them alternately to opposite sides of said path and direct the followed edges of the sheets alternately to one side and then the other side of said path, interrupting the movement of the sheets in the two said opposite sides to form a stack of the sheets with the followed edges of consecutive ones of the sheets being disposed on alternate opposite sides of the stack, monitoring the rate of moving of the sheets in the path in spaced-apart relation, synchronizing the three steps of engaging and moving and interrupting of the leading edges of the sheets relative to the rate at which the sheets are moving in the spaced-apart relation along the path, counting the sheets formed in the stack, and moving the counted stack away from the location of its formation.

* * * * *

UNITED STATES PATENT OFFICE

CERTIFICATE OF CORRECTION

PATENT NO. : 4,060,231

DATED : November 29, 1977

INVENTOR(S) : Stobb, Anton Rudolph
Stobb, Walter John

It is certified that error appears in the above-identified patent and that said Letters Patent are hereby corrected as shown below:

In Claim 9, line 2, "8" should read--7--; and in Claim 10, at column 11, line 2, the word "drive" should read--driver--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*